US005181607A

United States Patent [19]

Focke et al.

[11] Patent Number: 5,181,607

[45] Date of Patent: Jan. 26, 1993

[54] DIVISIBLE PACKAGE FOR A PLURALITY OF CIGARETTE PACKS

[75] Inventors: Heinz Focke, Verden; Bernhard Focke, Bremen, both of Fed. Rep. of Germany

[73] Assignee: Focke & Company, Verden, Fed. Rep. of Germany

[21] Appl. No.: 709,292

[22] Filed: Jun. 3, 1991

Related U.S. Application Data

[60] Division of Ser. No. 436,003, Nov. 14, 1989, Pat. No. 5,058,363, which is a division of Ser. No. 906,637, Sep. 10, 1986, Pat. No. 4,932,534, which is a continuation of Ser. No. 599,157, Apr. 11, 1984, abandoned.

[30] Foreign Application Priority Data

Apr. 14, 1983 [DE] Fed. Rep. of Germany ..... 3313462

[51] Int. Cl.[5] ..... B65D 85/10

[52] U.S. Cl. ..... 206/273; 206/192; 206/271

[58] Field of Search ..... 206/242, 271, 273, 192; 229/120.011, 120.09

[56] References Cited

U.S. PATENT DOCUMENTS

| | | | |
|---|---|---|---|
| 276,171 | 4/1883 | Fraser | 229/120.09 |
| 1,318,124 | 10/1919 | Wright . | |
| 3,048,321 | 8/1962 | Sanford . | |
| 3,092,301 | 6/1963 | Selle | 206/242 |
| 3,135,457 | 6/1964 | Risucci . | |
| 3,158,312 | 11/1964 | Simkins | 229/120.011 |
| 3,226,010 | 12/1965 | Rogers, Jr. . | |
| 3,241,738 | 3/1966 | Freiman | 229/120.011 |
| 3,447,733 | 6/1969 | Smith et al. | 229/120.011 |
| 3,677,458 | 7/1972 | Gosling | 229/120.011 |
| 4,256,223 | 3/1981 | Pawlowski | 206/192 |
| 4,294,353 | 10/1981 | Focke et al. . | |

FOREIGN PATENT DOCUMENTS 739899 11/1955 United Kingdom .

*Primary Examiner*—Paul T. Sewell
*Assistant Examiner*—Thomas P. Hilliard
*Attorney, Agent, or Firm*—Burns, Doane, Swecker & Mathis

[57] ABSTRACT

Cigarette cartons are packages with a relatively large number (for example, ten) of cigarette packs (30). Because of a special design of this cigarette carton or of a common blank (33), it becomes possible to divide the cigarette carton to form part packs (half-cartons 34, 35), each of these part packs as well as the complete cigarette carton forming a saleable unit which is convenient to handle.

12 Claims, 10 Drawing Sheets

88
84
96
41
37
48
48
48
40
38
90
87
86
85
87
95
94
93
95
91
89
92
95
38
41
37
40
96
83
88

DIVISIBLE PACKAGE FOR A PLURALITY OF CIGARETTE PACKS

This application is a divisional of application Ser. No. 07/436,003, filed Nov. 14, 1989, now U.S. Pat. No. 5,058,363, which is a divisional of application Ser. No. 06/906,637 filed Sep. 10, 1986, now U.S. Pat. No. 4,932,534, which is a continuation of application Ser. No. 06/599,157, filed Apr. 11, 1984, now abandoned.

FIELD OF THE INVENTION

The invention relates to a package for receiving a plurality of individual articles, especially cigarette packs (so-called cigarette carton), in an outer wrapping consisting of paper, cardboard or the like.

BACKGROUND OF THE INVENTION

Cigarette cartons are relatively large packaging units for cigarette packs. Conventionally, ten cigarette packs are combined to form a large pack of this type which is wrapped by means of a paper or cardboard blank.

OBJECTS AND SUMMARY OF THE DRAWINGS

The object on which the invention is based is to develop further packages of the type mentioned in the introduction, in such a way that the packages are more convenient to handle, especially when they are on sale.

To achieve this object, the package according to the invention is characterised in that connected part packs, especially half-cartons, can be separated from the package.

Accordingly, the package (cigarette carton) according to the invention is basically constructed in a conventional way as regards its external appearance, and therefore has a customary cuboid shape with a number of cigarette packs, preferably ten, wrapped by means of a blank. The particular feature is that it is possible to divide up the package (cigarette carton), to obtain part packs each convenient to handle per se, so that a smaller unit, especially a "half-carton" can be distributed, displayed or sold.

The outer wrapping of the package preferably consists of a single one-piece blank.

This is designed so that in the region of one edge, especially a lateral longitudinal wall, a severing line is formed within the blank in the dividing plane, so that the two half-cartons can be separated here by being served from one another.

Because a weakening of material, especially a perforation or the like, is provided at one of the edges of the longitudinal side walls, the package can be severed (manually) in a simple way by swinging the part packs onto one another and breaking the blank in the region of the severing line, the longitudinal side faces turned towards one another being supported against one another.

In a further exemplary embodiment of the package according to the invention, the longitudinal side of the half-cartons which faces the severing line or breaking line of the latter is open, in such a way that the end faces of the cigarette packs are exposed here. It is thereby possible to execute manipulations on the end faces of the cigarette packs, especially to apply revenue stamps or revenue imprints.

BRIEF DESCRIPTION OF THE DRAWINGS

Further features of the invention relate to the constructive design of the package in various embodiments and to measures for producing and closing such packages. Exemplary embodiments are explained in more detail below with reference to the drawings in which like elements bear like reference numerals and wherein.

DETAILED DESCRIPTION OF THE PREFERRED EMBODIMENTS

Figure 1:
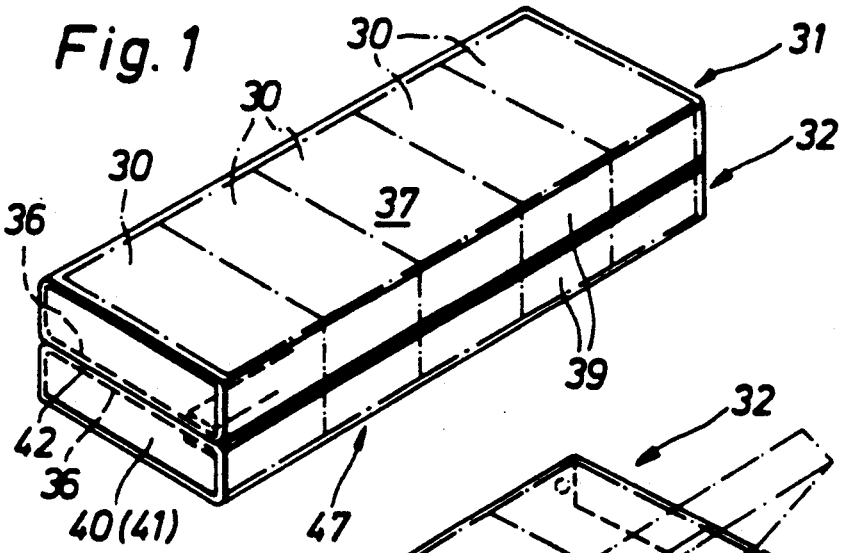
FIG. 1 shows a preferred exemplary embodiment of a cigarette carton in a perspective representation.
Figure 2:
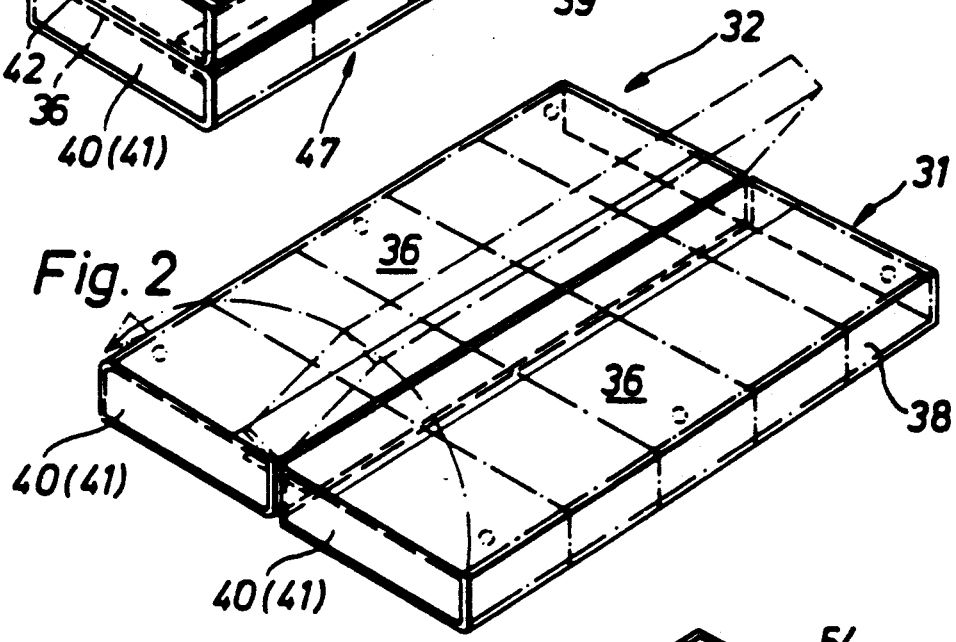
FIG. 2 shows the package according to FIG. 1 in an intermediate portion during its production.

The exemplary embodiments of the invention which are illustrated in the drawings relate to the packaging of cigarettes. Several individual cigarette packs 30 are to be accommodated in a larger package, namely a cigarette carton. In each of the exemplary embodiments illustrated, ten cigarette packs 30 altogether are combined to form a cigarette carton. The cigarette packs 30 are grouped in two rows of packs 31 and 32, specifically in such a way that the cigarette packs 30 are oriented with their longitudinal extension transverse to the longitudinal direction of the cigarette carton. The cigarette packs 30 are arranged to lie flat within the rows of packs 31, 32.

Figure 8:
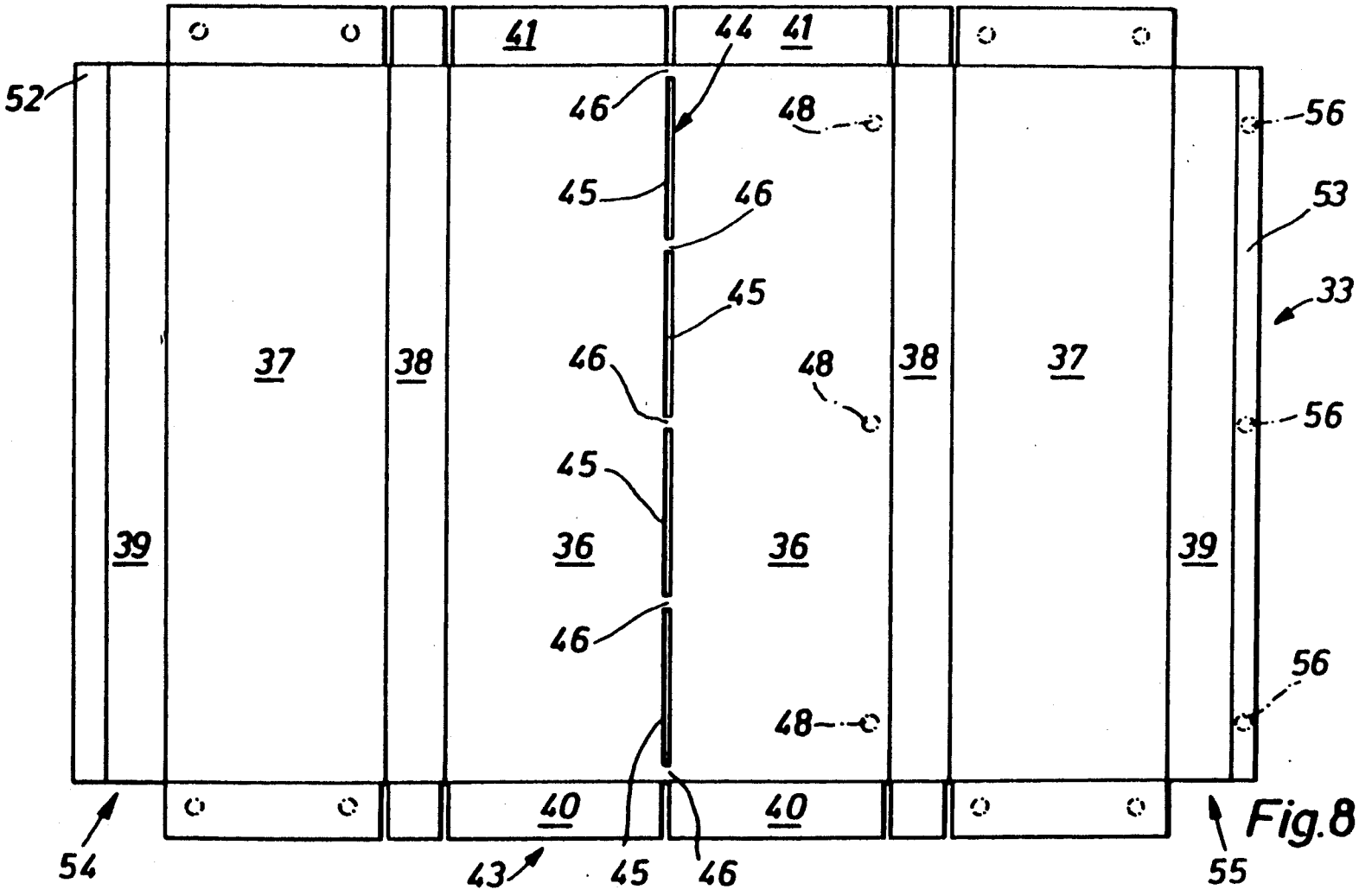
FIG. 8 shows a blank for a package according to FIGS. 1 to 7 in a spread-out state.

The group of ten cigarette packs 30 altogether is wrapped by means of a common blank 33 (FIG. 8). This can consist of paper, cardboard or even a suitable foil or a laminate product. The blank 33 is designed and folded in such a way that the rows of packs 31 and 32, that is to say the entire pack content, are completely enclosed.

Furthermore, the wrapping is designed so that each row of packs 31, 32 acquires a certain independence, such that part packs are obtained by severing or dividing the package, in the present case half-cartons 34 and 35 which accordingly each contain a row of packs 31 and 32 respectively (five cigarette packs 30). In the exemplary embodiment according to FIGS. 1 to 8, these half-cartons 34, 35 are completely enveloped all-round by means of covering walls 36, 37, longitudinal side walls 38 and 39 and end walls 40 and 41.

The common one-piece blank 33 (FIG. 8) is wrapped round the two rows of packs 31, 32 in such a way that when the package is complete the interconnected covering walls 36 of the two half-cartons 34 and 35 rest on one another (FIG. 1 and FIG. 4), specifically in the region of a dividing plane 42 for the package. The connection between the two covering walls 36 can be broken or severed. For this reason, a blank zone 43 forming the two covering walls 36 is provided centrally with a severing line 44 which consists of a perforation or severing cuts 45 with residual connections 46. The so-formed blank zone 43 of the blank 33 connects the two half-cartons 34 and 35 to one another, and the severing line 44 extends centrally in the region of a side face 47, formed by the two longitudinal side walls 39, of the complete package.

Figure 3:
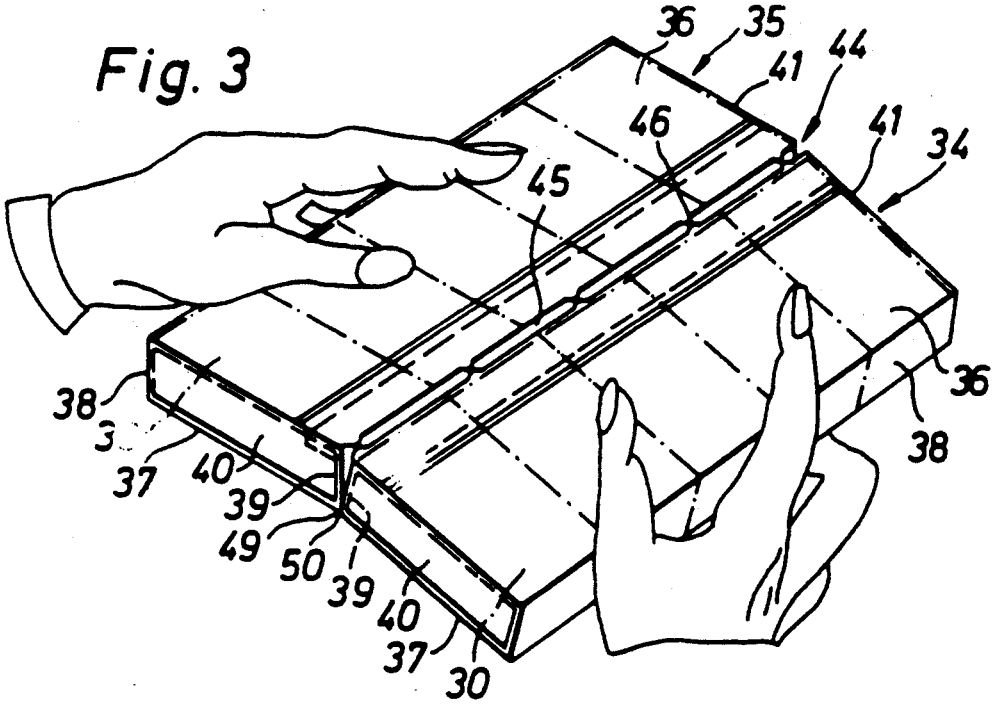
FIG. 3 shows the package according to FIGS. 1 and 2 when it is being divided.
Figure 5:
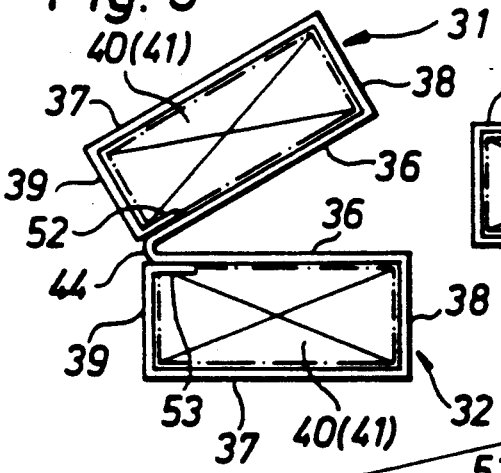
FIG. 5 shows the package in an end view during a phase of its production.
Figure 6:
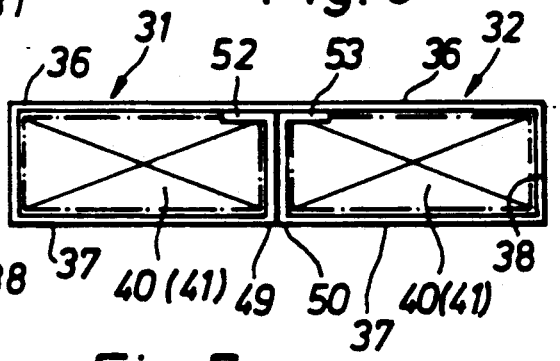
FIG. 6 shows an end view corresponding to the representation according to FIG. 3.
Figure 7:
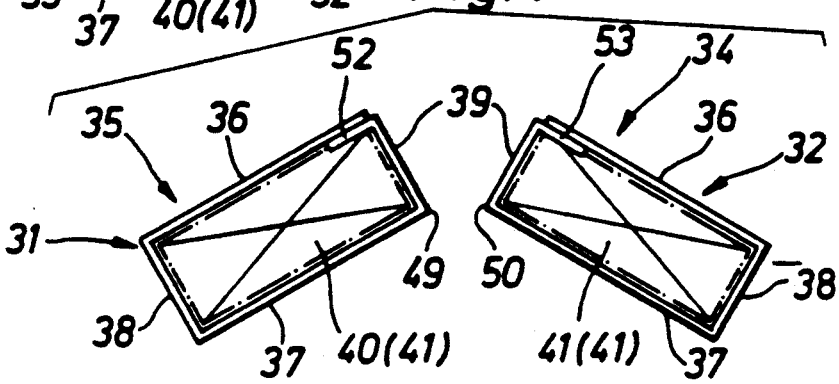
FIG. 7 shows an end view of the divided package consisting of two part packs.

In the present case, the complete cigarette carton (FIG. 1) is formed not only by connecting the half cartons 34 and 35 to one another in the region of the severing line 44 of the common blank 33, but also by means of further breakable connections, in the present case several spot-like glue points 48 which are provided, on the side of the half-cartons 34, 35 which is remote from the severing line 44, on the covering walls 36, facing one another, of the two half-cartons 34, 35. As a result of these breakable connections, a stable package (cigarette carton) marketable as a single unit and essentially having a conventional appearance (FIG. 1) is obtained. Alternatively, it is possible to divide the cigarette carton to form the half-cartons 34, 35. In this case, in the exemplary embodiment discussed here, the half-cartons 34, 35 must first be pivoted into a common plane (FIGS. 2 and 3) by breaking the glue points 48. The blank 33 can not be severed in the region of the severing line 44. In the present case, a particular breaking effect is utilised (FIG. 3). The two half-cartons 34, 35 are supported against one another by means of the longitudinal side walls 39 facing one another, and in particular supporting edges 49, 50, distant from the severing line 44, of the two half-cartons 34, 35 facilitate the (manually executed) breaking effect via these supporting edges 49, 50.

The present package is designed to comply with particular revenue regulations such as those in force, for example, in the USA. The individual cigarette packs 30 are to be provided in the region of end faces 51 with a revenue stamp or an imprint after the cigarette carton has been (largely) completed. For this reason, a provisional closing position of the cigarette carton is first formed here, as is evident from FIG. 4 and FIG. 12.

The blank parts forming the common side face 47 (with the severing line 44) of the cigarette carton are, on the one hand, the (strip-shaped) longitudinal side walls 39 and, on the other hand, a connecting edge strip 52, 53 adjoining each of these. When the cigarette carton is completed, the latter are folded inwards and each lie between an edge region of the covering walls 36 and the wrapped cigarette packs 30. The connecting edge strips 52, 53 are joined to the associated covering wall 36 by means of glue spots.

Figure 4:
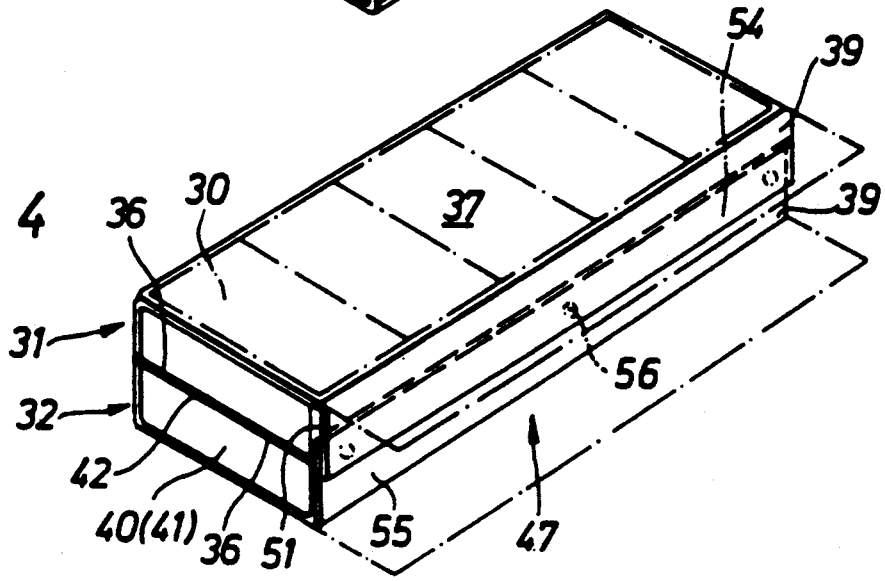
FIG. 4 shows the package according to FIGS. 1 to 3, in an intermediate closing position.
Figure 11:
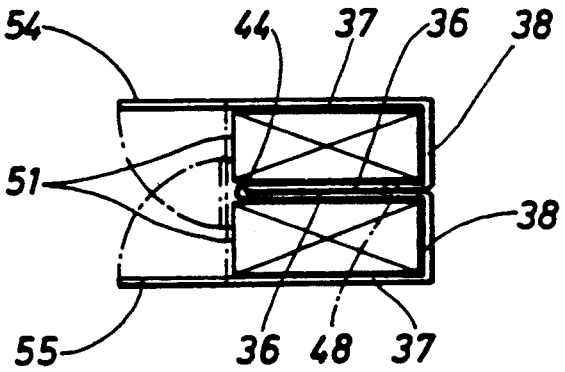
FIG. 11 shows an end view of the design of the package before the intermediate closing position is assumed.
Figure 12:
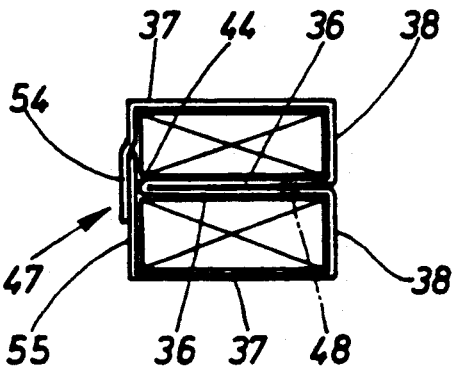
FIG. 12 shows an end view of the intermediate closing position.

The above-mentioned intermediate closing position according to FIG. 4 and FIG. 12 is such that lateral closing tabs 54 and 55, formed from the longitudinal side walls 39 and the adjoining connecting edge strips 52, 53 are connected releasably to one another whilst overlapping one another. For this purpose, glue spots 56 are provided on the connecting edge strip 53, and these ensure this releasable closure according to FIG. 12. To apply the revenue number or other markings on the end faces 51 of the cigarette packs 30, the lateral closing tabs 54, 55 are pivoted, the glue spots 56 being broken at the same time, into a position approximately according to FIG. 11 or as shown by dot-and-dash lines in FIG. 4, so that a suitable device can be brought up to the end faces 51.

After this measure, the final form of the cigarette carton according to FIG. 1 is produced, the connecting edge strips 52, 53 being folded inwards in the above-mentioned way.

Figure 9:
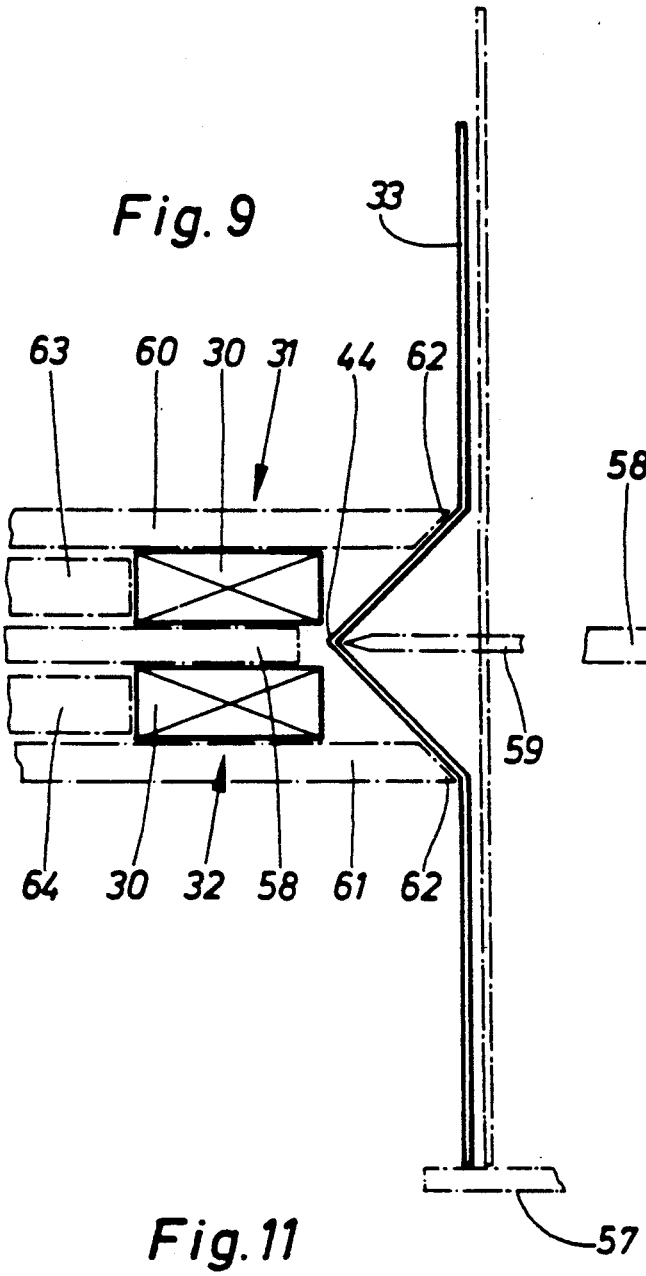
FIG. 9 shows, in a diagrammatic end view, a phase during the production of a package using a blank according to FIG. 8.
Figure 10:
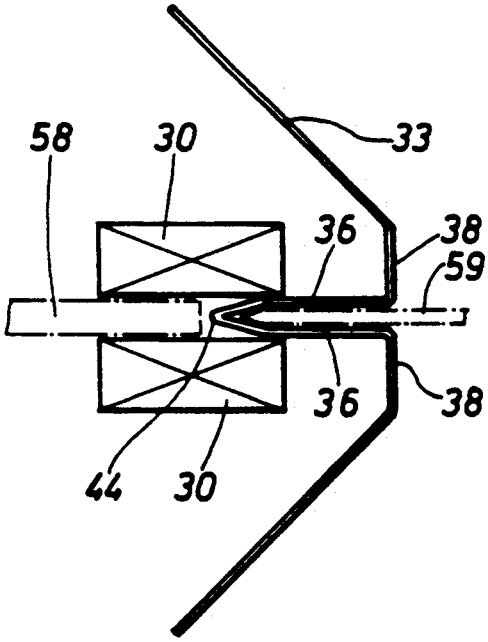
FIG. 10 shows a representation similar to FIG. 9 for a further phase of production of the package.

In the production of the present packages (cigarette cartons) from a blank 33 according to FIG. 8, the procedure can, according to FIGS. 9 and 10, be, for example, to sever the blank 33 from a continuous sheet and fix it in an upright position on a lower stop 57. The two rows of packs 31 and 32 are supplied in a horizontal plane perpendicularly to the drawing plane in relation to FIG. 9. The rows of packs 31 and 32 are retained at a distance from one another by an intermediate guide 58. By means of a folding blade 59 and by means of plate-shaped abutments 60 and 61 located above and below the rows of packs 31, 32, and having folding edges 62 ending obliquely or tapering to a point, the blank 33 is pre-folded approximately in the form of a V, the fold being located in the region of the severing line 44. In the continuing process, the part of the blank 33 forming the covering walls 36 and located between the rows of packs 31, 32 is folded (FIG. 10), and the intermediate guide 58 is retracted correspondingly a at the same time. The rows of cigarettes are supported laterally by abutments 63, 64. At the same time, the longitudinal side walls 38 in the blank 33 are pre-folded by further folding members not sown in detail, so that the rows of packs 31, 32 are covered at the top and bottom by blank parts finally directed horizontally (FIGS. 10 and 11).

When the provisional closing position according to FIG. 12 is assumed, the pack is consequently completed, the end walls 40, 41 being folded over in a suitable way by known folding members.

Figure 13:
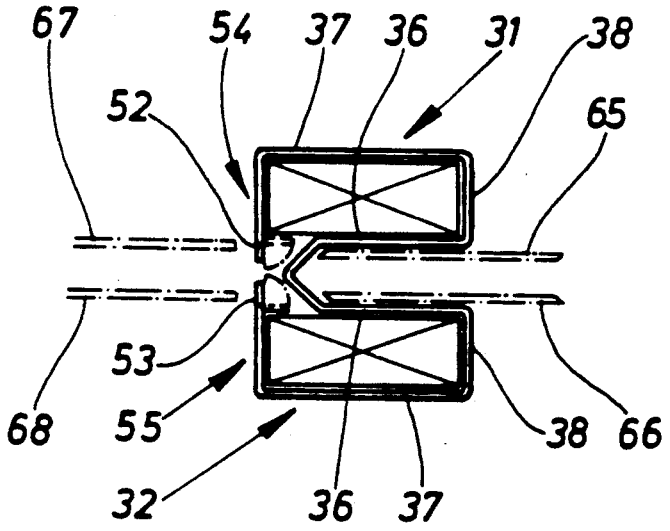
FIG. 13 shows a side view of the package at the completion stage after the intermediate closing position has been cancelled.
Figure 14:
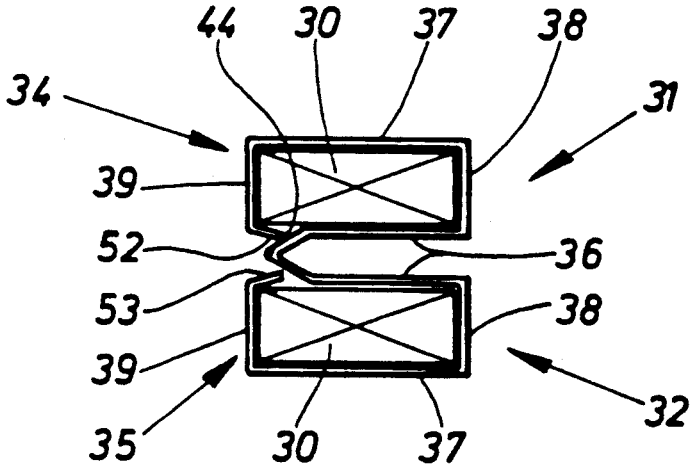
FIG. 14 shows a further production phase subsequent to that according to FIG. 13.
Figure 15:
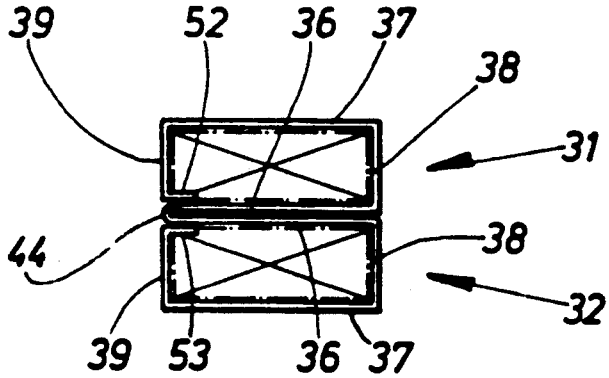
FIG. 15 shows the completion of the package for final consumption.
Figure 18:
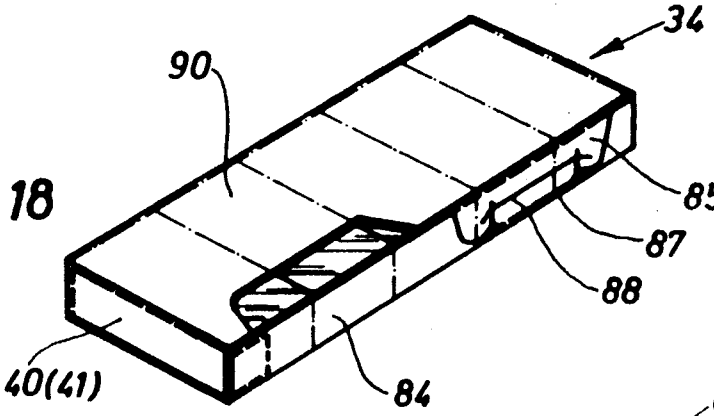
FIG. 18 shows a part pack related to FIGS. 16 and 17.
Figure 17:
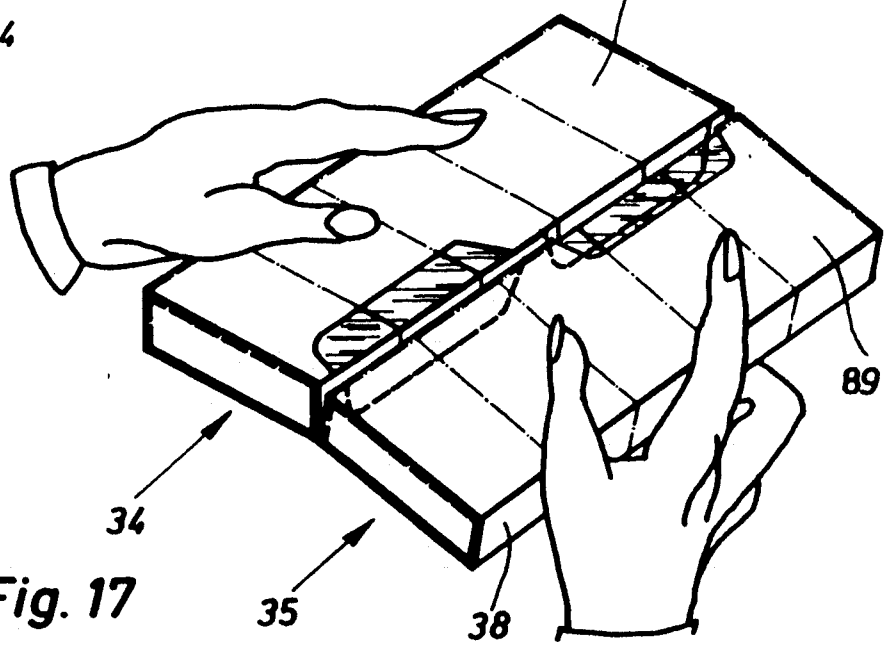
FIG. 17 shows the division of a package according to FIG. 16.
Figure 16:
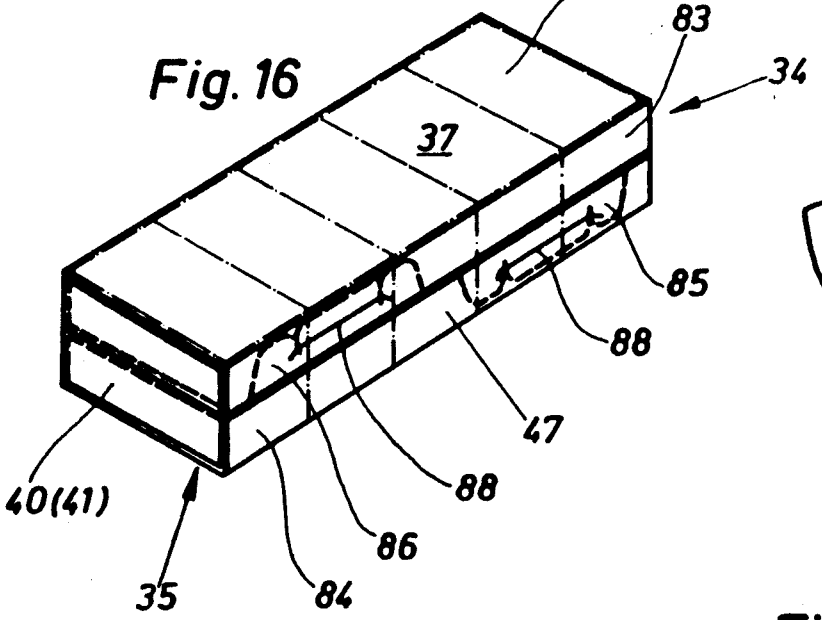
FIG. 16 shows a further exemplary embodiment of a package with a closing flap, in a perspective representation similar to FIG. 1.

To form the saleable design of the cigarette carton, the connection between the lateral closing tabs 54, 55 is broken again, as already mentioned. To fold the connecting edge strips 52, 53 into the final position, the rows of packs 31, 32 (wrapped in the blank 33) are spaced apart from one another (FIG. 13) by means of appropriately designed and movable spreader strips 65 and 66. These also expose the edge regions, facing one another, of the cigarette packs 30, so that the connecting edge strips 52, 53 extending in a common lateral plane can be folded by associated folding tongues 67, 68 against the sides facing one another of the cigarette packs 30 (FIG. 13). After the spreader strips 65 and 66 and folding tongues 67, 68 have been retracted, the rows of packs 31 and 32 still located at a distance from one another are pressed together, that is to say moved towards one another, so that the above-described construction of the cigarette carton according to FIG. 15 is provided. At the same time, the covering walls 36 are connected to one another by means of the previously activated glue spots 48.

The embodiment of a cigarette carton according to FIG. 16 to FIG. 22 corresponds in its basic design and function to those already described. The cigarette carton (FIG. 16) is formed from a one-piece blank according to FIG. 19. A cigarette carton of essentially conventional shape with the two half-cartons 34 and 35 is obtained.

The particular feature of this exemplary embodiment is that the longitudinal side walls 83 and 84, forming the common side face 47 of the cigarette carton 23, of the two half-cartons 34, 35 are designed in a special way. In particular, an insertion flap 85, 86 is assigned to each of them. The insertion flaps 85, 86 are located at a distance from one another over the length of the longitudinal side walls 83, 84, that is to say are off-center. They are activated or are formed only when the cigarette carton (FIG. 16) is divided into the part packs (half-cartons 34, 35). The insertion flaps 85, 86 are then released and, by being folded over into the plane of the longitudinal side wall 83 or 84, can be introduced by means of a delimited insertion tongue 87 into a retaining slit 88 arranged at a suitable location in the longitudinal side wall 83 or 84.

The insertion flaps 85, 86 are formed by parts of the covering walls 89, 90, facing one another and connected releasably to one another, of the parts packs (half-cartons 34, 35). For this purpose, the insertion flaps 85 and 86 are formed by means of appropriate respective stampings 91 and 91 in the blank zone 93 for the covering walls 89 and 90. Consequently, the insertion flaps 85 and 86 also function as part of the severing line 94 which is formed between the covering walls 89 and 90 in the way already described. Residual connections 95 are formed, here, in the severing line 94, that is to say in the region between the insertion flaps 85 and 86. As a result, to divide the cigarette carton so as to form the half-cartons 34, 35, the procedure is the same as in the exemplary embodiment according to FIG. 1 and the following Figures, that is to say breaking against one another the spread-out half-cartons 34, 35 extending in the same plane.

Figure 19:
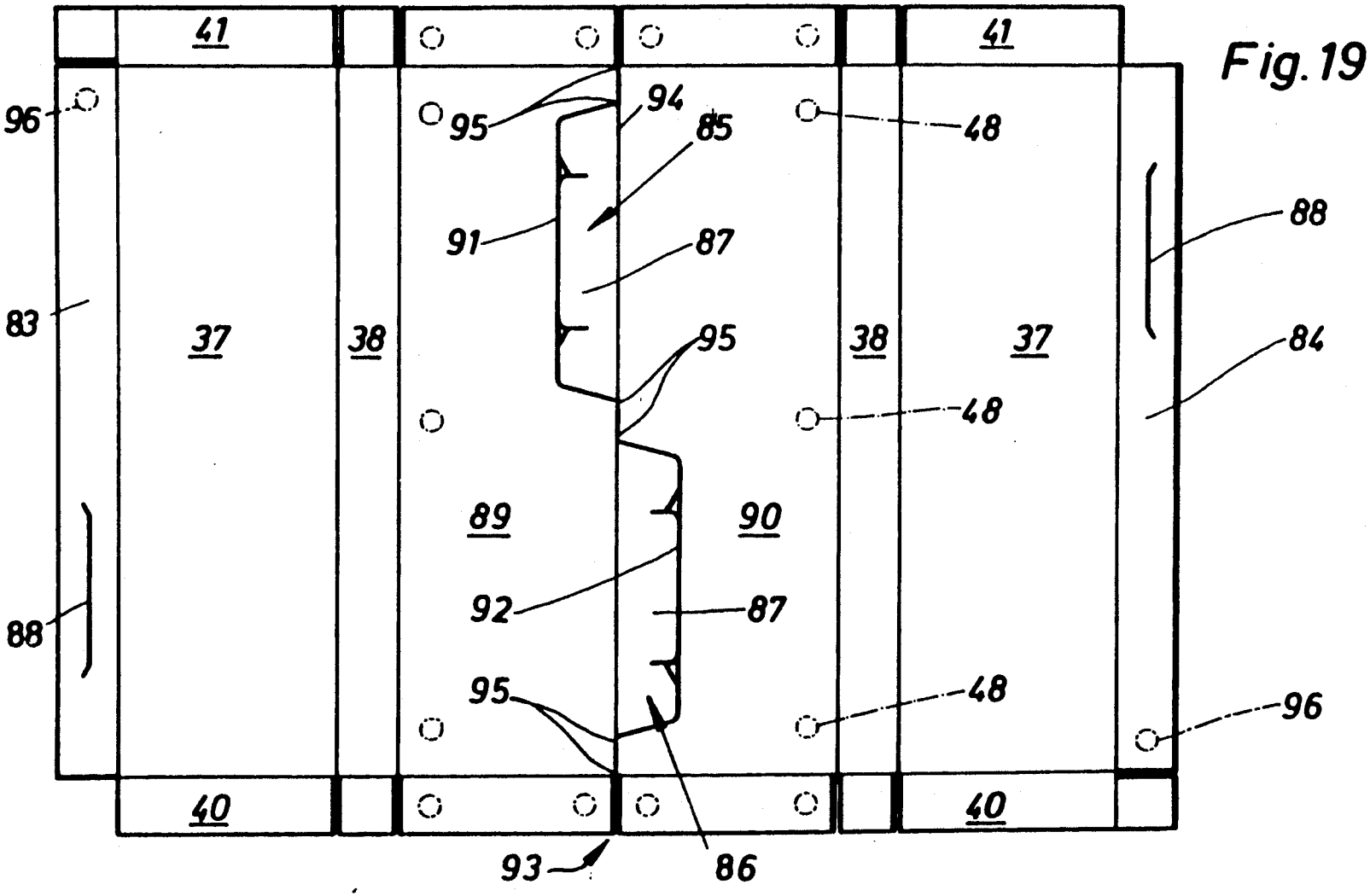
FIG. 19 shows a spread-out blank for a package according to FIGS. 16 to 18.
Figure 20:
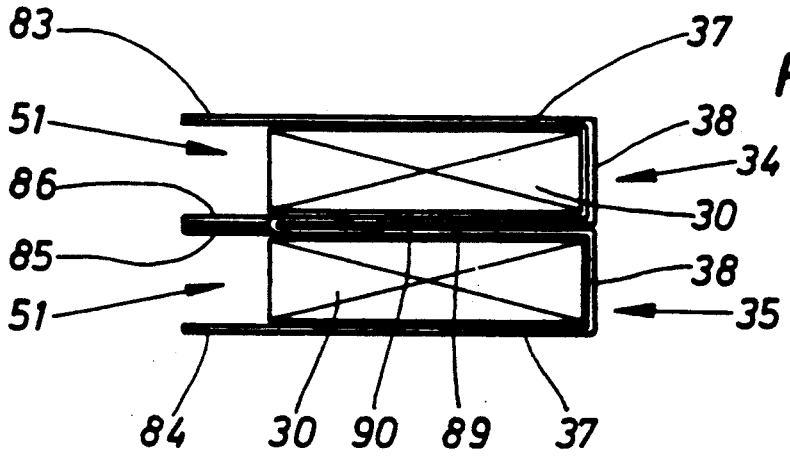
FIG. 20 shows, in an end view, a phase during the production of a package from a blank according to FIG. 19.
Figure 21:
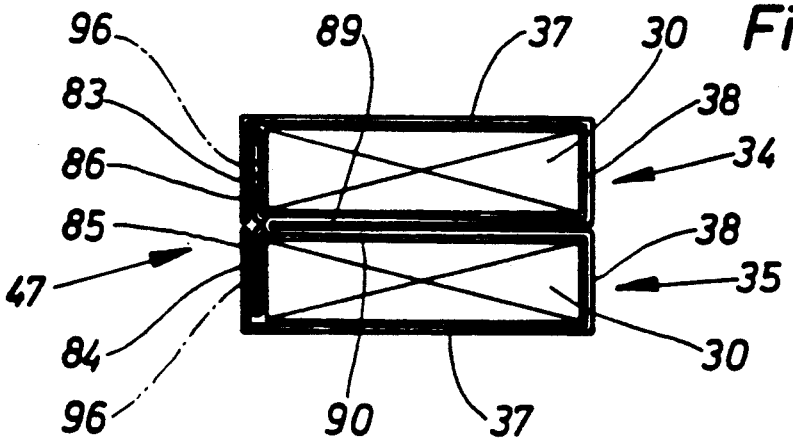
FIG. 21 shows, in an end view, a finished pack (cigarette carton) related to the exemplary embodiment according to FIGS. 16 to 20.
Figure 22:
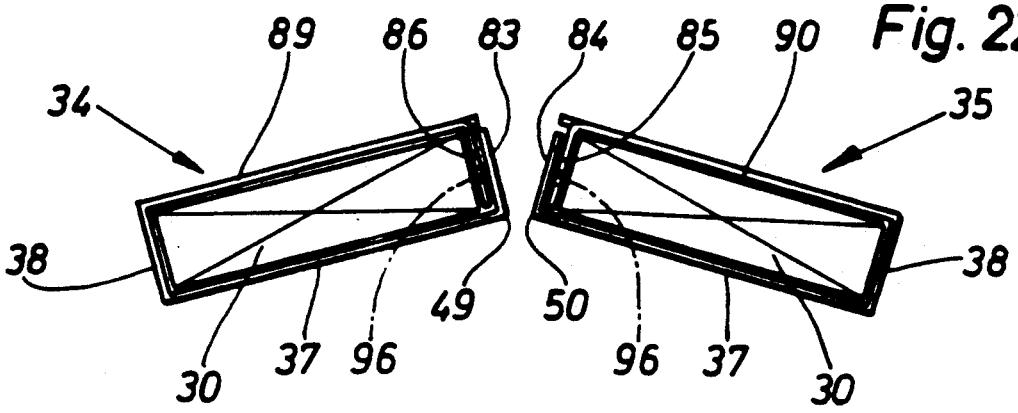
FIG. 22 shows a severed package of the exemplary embodiment according to FIG. 19 which consists of two part packs.

When a package (cigarette carton) is produced from a blank according to FIG. 19, according to the present exemplary embodiment the procedure is such that the completely stamped-out insertion tongues 87 are aligned with the covering walls 89 and 90 so as to project transversely, that is to say as a prolongation of the latter when these are folded in between the rows of packs 31, 32, so as to rest against one another, by being folded over 180° (FIG. 20). Accordingly, the insertion flaps 85, 86 extend transversely relative to the common side face 47 of the package. The insertion flaps 85, 86 are then folded over against the end faces 51 of the cigarette packs 30. The longitudinal side walls 83 and 84 initially projection at the top and bottom (FIG. 20) are then folded, in turn, against these end faces. The longitudinal side walls are each provided with a glue spot 96 which forms a (releasable) connection between the longitudinal side walls 83, 84 and the associated insertion flaps 85, 86.

When the cigarette carton formed in this way is divided, the glue points 48 are first broken and the half-cartons 34, 35 pivoted into a common plane. It is then severed in the way described in the region of the severing line 94, the residual connections 95 being severed at the same time.

To enable each part pack (half-carton 34, 35) to be used, the glue spots 96 can now be broken, so that the connection between the longitudinal side walls 83, 84 and the associated insertion flaps 85, 86 is removed. The latter can now be introduced by means of the insertion tongue 87 into the retaining slit 88 in the longitudinal side wall 83 84, so that a reclosable half-carton 34, 35 is provided.

Figure 23:
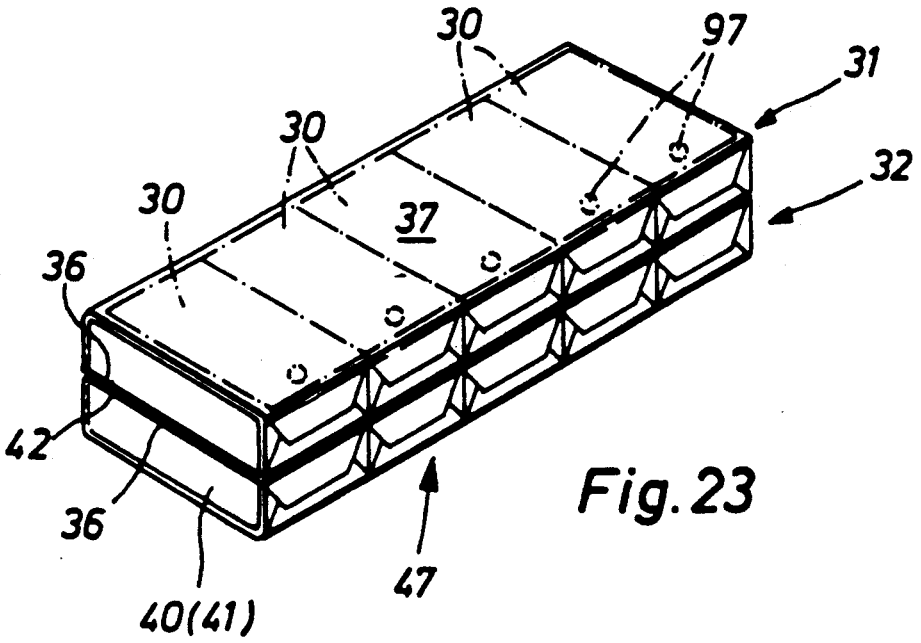
FIG. 23 shows, in perspective, an exemplary embodiment of the pack similar to that according to FIGS. 1 to 3, but with open longitudinal sides.
Figure 24:
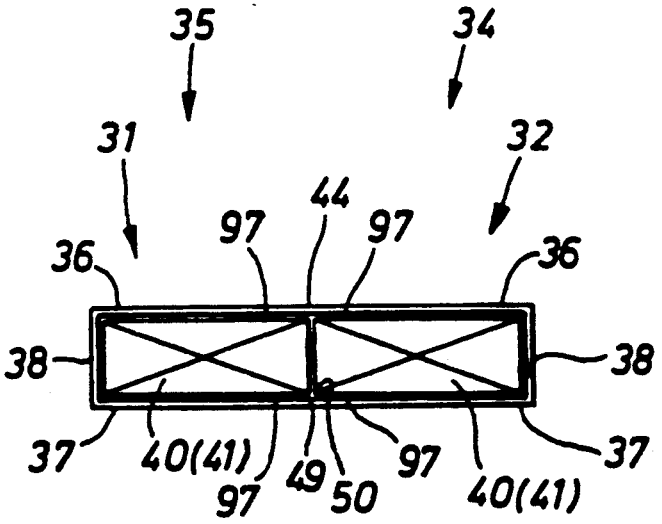
FIG. 24 shows the pack according to FIG. 23 in cross-section, with the part packs spread out.
Figure 25:
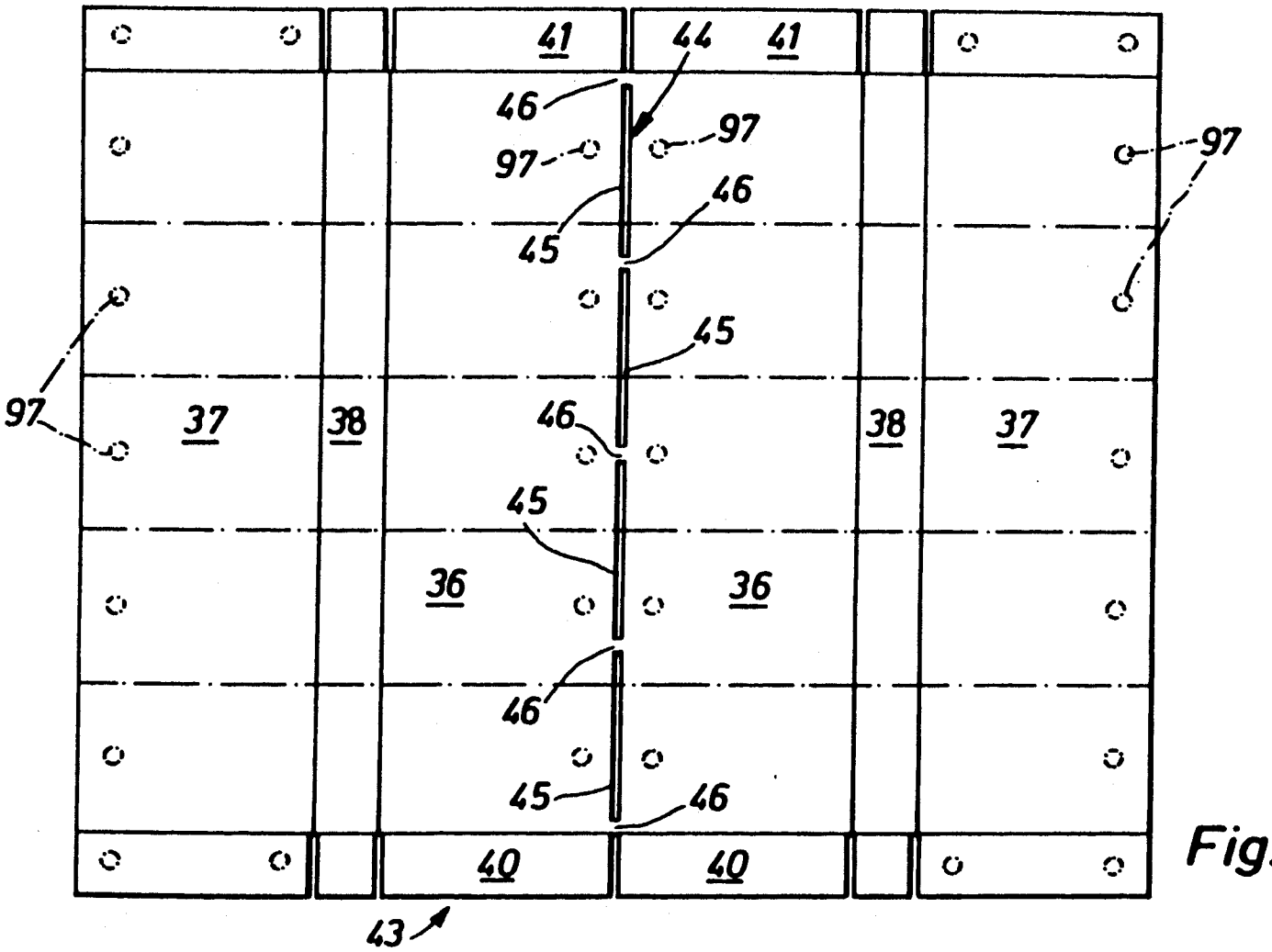
FIG. 25 shows a spread-out blank for producing a pack according to FIGS. 23 and 24.

The pack according to FIG. 23 to FIG. 25 is especially suitable for uses in which measures are subsequently to be taken on the end faces of the cigarette packs 30 and in which, in particular, revenue markings are to be applied. In this exemplary embodiment, the longitudinal side walls 39 adjacent to the severing line 44 are omitted, so that the two half-cartons 34 and 35 are open in the region of these longitudinal sides. The end faces of the cigarette packs 30 are exposed here.

To fix the cigarette packs 30 in the open half-cartons 34, 35, each cigarette pack 30 is connected releasably to one of the walls of the half-cartons 34, 35 especially to the two covering walls 36, 37. In the present case, a glue spot 97 is provided on each covering wall for each cigarette pack 30 to enable it to be fixed in the half-carton 34, 35.

What is claimed is:

1. A package for receiving a plurality of cigarette packs comprising:

two discrete partial packages, each of which receives a row of adjacent cigarette packs, each discrete partial package having first and second oppositely positioned covering walls, the first covering wall of one discrete partial package being connected to the first covering wall of the other discrete partial package along a severing line so that the two discrete partial packages are separable from each other along the severing line;

the first covering wall of the one discrete partial package having an outer surface and the first covering wall of the other discrete partial package having an outer surface, the outer surface of the first covering wall of the one discrete partial package facing the outer surface of the first covering wall of the other discrete partial package and the first covering wall of the one discrete partial package being releasably connectable to the first covering wall of the other discrete partial package by means of a plurality of spaced glue points that are positioned between the facing outer surfaces of the one discrete partial package and the other discrete partial package;

said severing line including a severing cut and a plurality of material connection points positioned along the severing line for connecting the first covering wall of the one discrete partial package to the first covering wall of the other discrete partial package; and a longitudinal side wall extending between the first and second covering walls of the one discrete partial package, a side of the one discrete partial package opposite to said longitudinal side wall being open so that when cigarette packs are placed in the one discrete partial package, edge faces of the cigarette packs are exposed through the open side, and a longitudinal side wall extending between the first and second covering walls of the other discrete partial package, a side of the other discrete partial package opposite to said longitudinal side wall being open so that when cigarette packs are placed in the other discrete partial package, edge faces of the cigarette packs are exposed through the open side.

2. A package according to claim 1, wherein each of the discrete partial packages includes a plurality of glue spots positioned on an inner face of one of the covering walls for releasably fixing the cigarette packs to at least one covering wall of the respective discrete partial package.

3. A package for receiving a plurality of cigarette packs comprising:

two discrete partial packages, each of which receives a row of adjacent cigarette packs, each discrete partial package having first and second oppositely positioned covering walls, the first covering wall of one discrete partial package being connected to the first covering wall of the other discrete partial package along a severing line so that the two discrete partial packages are separable from each other along the severing line;

the first covering wall of the one discrete partial package having an outer surface and the first covering wall of the other discrete partial package having an outer surface, the outer surface of the first covering wall of the one discrete partial package facing the outer surface of the first covering wall of the other discrete partial package and the first covering wall of the one discrete partial package being releasably connectable to the first covering wall of the other discrete partial package by means of a plurality of spaced glue points that are positioned between the facing outer surfaces of the one discrete partial package and the other discrete partial package;

said severing line including a severing cut and a plurality of material connection points positioned along the severing line for connecting the first covering wall of the one discrete partial package to the first covering wall of the other discrete partial package;

a longitudinal side wall attached to and connecting the first and the second covering walls of the one discrete partial package and a longitudinal side wall attached to and connecting the first and the second covering walls of the other discrete partial package; and securing means positioned on an inner face of at least one of the covering walls of each discrete package for releasably securing cigarette packs in the discrete packages.

4. A package according to claim 3, wherein said securing means includes a plurality of spaced apart glue spots.

5. A package according to claim 3, wherein securing means are provided on an inner face of both covering walls of each discrete package.

6. A package according to claim 5, wherein a side of each discrete partial package opposite to the respective longitudinal side walls are open so that when cigarette packs are positioned in the discrete partial packages, edge faces of the cigarette packs will be exposed through the open sides.

7. A package for receiving a plurality of cigarette packs comprising:

two discrete partial packages, each discrete partial package having first and second oppositely positioned covering walls, the first covering wall of one discrete partial package being connected to the first covering wall of the other discrete partial package along a severing line so that the two discrete partial packages are separable from each other along the severing line;

each discrete partial package receiving a row of adjacent cigarette packs;

the first covering wall of the one discrete partial package having an outer surface and the first covering wall of the other discrete partial package having an outer surface, the outer surface of the first covering wall of the one discrete partial package facing the outer surface of the first covering wall of the other discrete partial package and the first covering wall of the one discrete partial package being releasably connectable to the first covering wall of the other discrete partial package by means of a plurality of spaced glue points that are positioned between the facing outer surfaces of the one discrete partial package and the other discrete partial package;

said severing line including a severing cut and a plurality of material connection points positioned along the severing line for connecting the first covering wall of the one discrete partial package to the first covering wall of the other discrete partial package;

a longitudinal side wall attached to and extending transversely from the second covering wall of the one discrete partial package and a longitudinal side wall attached to and extending transversely from the second covering wall of the other discrete partial package; and an insertion flap extending from the first covering wall of at least the one discrete partial package, the longitudinal side wall extending from the second covering wall of at least the one discrete partial package including a retaining slit for receiving the insertion flap extending from the first covering wall of the one discrete partial package.

8. A package of claim 7, including an insertion flap extending from the first covering wall of the other discrete partial package at a position adjacent the severing line.

9. A package according to claim 8, wherein the longitudinal side wall attached to the second covering wall of the other discrete partial package includes a retaining slit for receiving the insertion flap extending from the first covering wall of the other discrete partial package.

10. A package according to claim 8, wherein said insertion flaps extend transversely from the first covering walls, the longitudinal side wall extending from the second covering wall of the one discrete partial package overlapping the insertion flap extending from the first covering wall of the one discrete partial package and the longitudinal side wall extending from the second covering wall of the other partial package overlapping the insertion flap extending from the first covering wall of the other discrete partial package.

11. A package according to claim 10, wherein the longitudinal side wall extending from the second covering wall of the one discrete partial package includes a plurality of spaced glue spots for releasably connecting that longitudinal side wall to the insertion flap extending from the first covering wall of the one discrete partial package and the longitudinal side wall extending from the second covering wall of the other discrete partial package includes a plurality of spaced glue spots for releasably connecting that longitudinal side wall to the insertion flap extending from the first covering wall of the other discrete partial package.

12. A package for receiving a plurality of cigarette packs comprising:

two discrete partial packages, each discrete partial package having first and second oppositely positioned covering walls, the first covering wall of one discrete partial package being directly connected to the first covering wall of the other discrete partial package along a severing line so that the two discrete partial packages are separable from each other along the severing line;

each discrete partial package receiving a row of adjacent cigarette packs;

the first covering wall of the one discrete partial package having an outer surface and the first covering wall of the other discrete partial package having an outer surface, the outer surface of the first covering wall of the one discrete partial package facing the outer surface of the first covering wall of the other discrete partial package and the first covering wall of the one discrete partial package being releasably connectable to the first covering wall of the other discrete partial package by means of a plurality of spaced glue points that are positioned between the facing outer surfaces of the one discrete partial package and the other discrete partial package;

said severing line including a severing cut and a plurality of material connection points positioned along the severing line for connecting the first covering wall of the one discrete partial package to the first covering wall of the other discrete partial package;

a longitudinal side wall attached to and extending transversely from the second covering wall of the one discrete partial package and a longitudinal side wall attached to and extending transversely from the second covering wall of the other discrete partial package, the longitudinal side walls attached to the second covering walls of the discrete partial packages extending towards one another to define a side face of the package; and an insertion flap extending from the first covering wall of each of the other discrete partial packages at a position adjacent the severing line, said insertion flaps extending transversely from the first covering walls, the longitudinal side wall extending from the second covering wall of the one discrete partial package overlapping the insertion flap extending from the first covering wall of the one discrete partial package and the longitudinal side wall extending from the second covering wall of the other partial package overlapping the insertion flap extending from the first covering wall of the other discrete partial package.

* * * * *